United States Patent [19]

Franke, Jr. et al.

[11] 4,319,473

[45] Mar. 16, 1982

[54] APPARATUS FOR CORRUGATING A METAL TAPE

[75] Inventors: Edward L. Franke, Jr., Perry Hall; George E. Hartranft, Baltimore County; Amrutlal D. Patel, Annapolis, all of Md.

[73] Assignee: Western Electric Company, Inc., New York, N.Y.

[21] Appl. No.: 70,385

[22] Filed: Aug. 28, 1979

[51] Int. Cl.[3] ..... B21B 31/18; B21D 13/04

[52] U.S. Cl. ..... 72/196; 72/247; 72/250

[58] Field of Search ..... 72/191, 196, 197, 192, 72/243, 247, 250

[56] References Cited

U.S. PATENT DOCUMENTS

| | | | |
|---|---|---|---|
| 1,212,482 | 1/1917 | Harrison | 72/187 |
| 1,833,658 | 11/1931 | Pullan | 72/197 X |
| 1,937,466 | 11/1933 | Smith | 72/187 |
| 1,962,896 | 6/1934 | Dewald | 72/161 |
| 2,047,883 | 7/1936 | Phillips | 72/243 |
| 2,279,415 | 4/1942 | Simon | 72/243 |
| 3,054,439 | 9/1962 | Hallam | 72/12 |
| 3,398,566 | 8/1968 | Garvey | 72/250 |
| 3,830,088 | 8/1974 | Sansome et al. | 72/196 |

*Primary Examiner*—Lowell A. Larson
*Attorney, Agent, or Firm*—D. D. Bosben

[57] ABSTRACT

A pair of opposed corrugating rollers (22 and 24) are supported on a frame (52) for corrugating a metal tape (20). The corrugating rollers (22 and 24) are supported for continuous reciprocating movement laterally of the tape (20) during the corrugating operation to distribute wear evenly over the surface of the rollers.

9 Claims, 10 Drawing Figures

APPARATUS FOR CORRUGATING A METAL TAPE

TECHNICAL FIELD

This invention relates to an apparatus for corrugating a metal tape and particularly to a corrugating apparatus having a pair of corrugating rollers which move continuously laterally of the tape to reduce localized wear of the rollers.

BACKGROUND OF THE INVENTION

In the fabrication of a metal sheath for a cable, a flat aluminum or steel tape is advanced between a pair of opposed forming rollers having corrugating ribs which mutually cooperate to produce lateral corrugations in the tape prior to the tape being formed about the cable. It is important during the corrugation process to maintain a uniform depth of corrugation across the width of the tape to enhance flexibility of the sheathed cable in the ultimate handling thereof. However, uniform depth of corrugations has been difficult to achieve in the past wherein tapes of different widths must be processed in the same prior art apparatus. After a certain amount of tape has been passed between the rollers of the apparatus, the corrugating ribs of the rollers begin to exhibit wear, particularly in the areas where the tape is normally passed. For instance, if a narrow strip of tape is passed between the rollers, the wear on the corrugating ribs is localized in a correspondingly narrow section of the rollers. Thus, when a tape of a greater width is subsequently passed between the rollers of the apparatus, the depth of corrugation across the width of the wider tape will be non-uniform because of the localized wear of the corrugating ribs produced by the narrower tape. The resultant non-uniformity of the depth of corrugation then necessitates the replacement of the locally-worn corrugating rollers with a new set of rollers for processing the wider tape, resulting in the constant changing of rollers to accommodate tapes of different widths.

In a prior art apparatus of this type, a guide assembly having spaced guide walls is used to guide the tape into position for passage between the forming rollers. To accommodate tapes of different widths within the same apparatus, the guide mechanism is adjustable to permit variation in the space between the guide walls.

In the prior art apparatus, the corrugating rollers of relatively small diameters tended to deflect laterally of the axis thereof which could also result in uneven or non-uniform depth of the corrugations formed across the width of the tape. To eliminate this problem, the corrugating apparatus also typically required at least one set of back-up rollers in face-to-face engagement with the corrugating rollers which supplied sufficient pressure to prevent deflection of the corrugating rollers during the corrugation process. The back-up rollers were positioned parallel to and in pressure-engagement with the corrugating rollers. This arrangement of the back-up rollers caused a considerable amount of noise to be developed during the corrugating operation due to the constant pressure-engagement of the corrugating rollers with the back-up rollers. The back-up rollers also hampered and lengthened the time required for set-up efforts when the corrugating rollers had to be replaced or adjusted.

U.S. Pat. No. 2,047,883 which issued on July 14, 1936, to C. W. Phillips, discloses a rolling mill for reducing the thickness of metal strips. The apparatus includes a pair of back-up rollers mounted in parallel relationship to a pair of working or compression rollers. The back-up rollers preferably are of an intermediate diameter such that they neither readily deflect during a corrugating operation, nor cause stretching and thinning of the tape 20 during the corrugating operation which are fixedly mounted for rotation only, cooperated with the compression rollers to facilitate the rolling operation. The compression rollers are mounted on a conveyor which is shiftable laterally relative to the metal strip and axially with respect to the back-up rollers, to insure uniformity of wear on the working surface of the compression rollers. Since the back-up rollers, which are fixedly mounted, are in constant pressure-engagement with the compression rollers during the rolling operation, it would appear that the rolling operation would have to be interrupted to facilitate lateral movement of the compression rollers.

SUMMARY OF THE INVENTION

This invention contemplates an apparatus for forming corrugations in a metal tape wherein corrugating rollers are mounted for continuous reciprocating movement relative to the advancing tape during the corrugation operation. Such reciprocating movement provides for the avoidance of localized wear on the corrugating rollers.

DESCRIPTION OF THE DRAWINGS

FIG. 7 is a block diagram showing the arrangement of FIGS. 5 and 6;

DETAILED DESCRIPTION

Figures 1, 10:
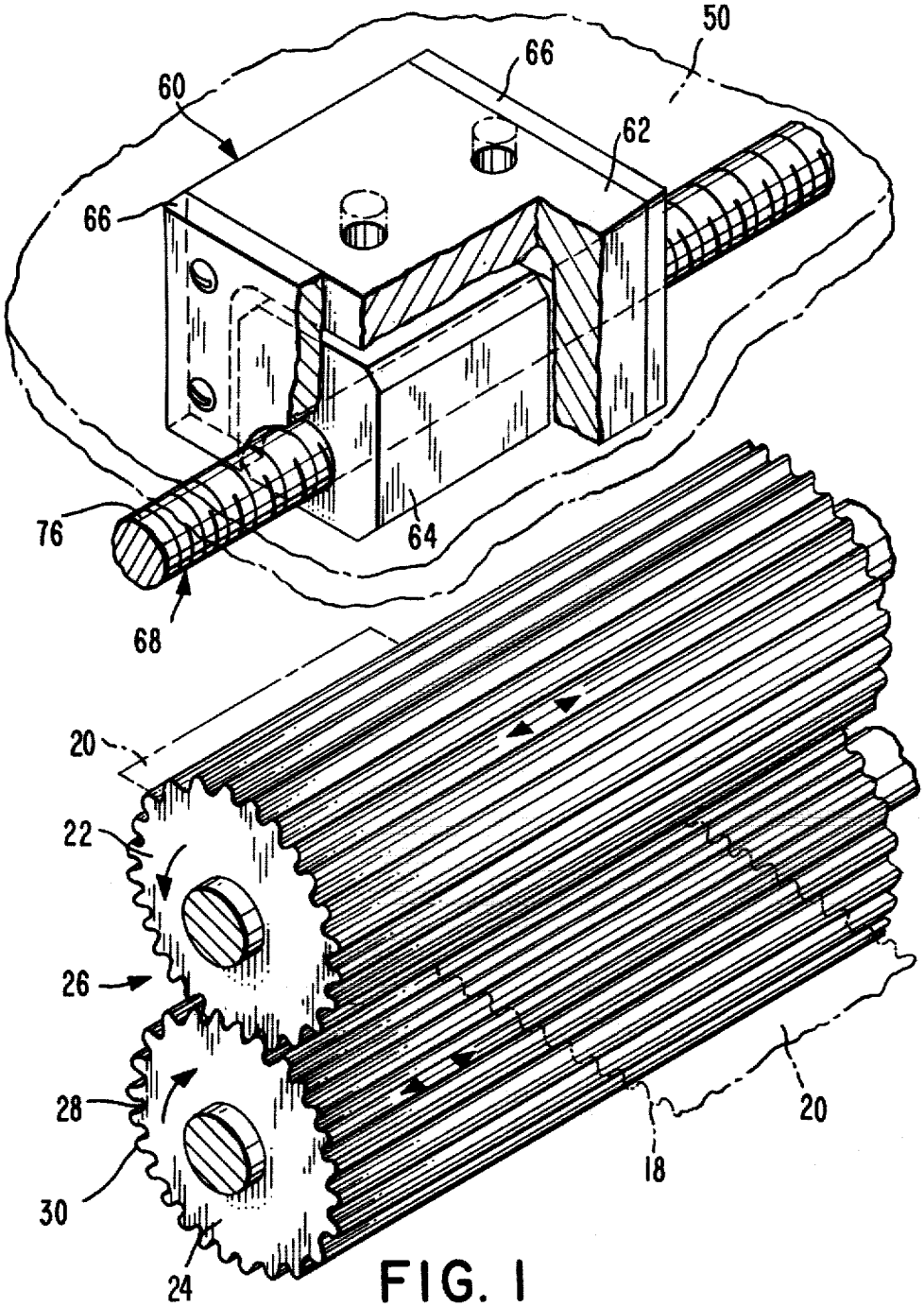
FIG. 1 is a perspective view of a pair of corrugating rollers.
FIG. 10 is a perspective view of a drive mechanism for reciprocating a portion of the corrugating apparatus.
Figure 4:
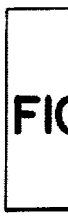
FIG. 4 is a block diagram showing the arrangement of FIGS. 2 and 3.
Figure 2:
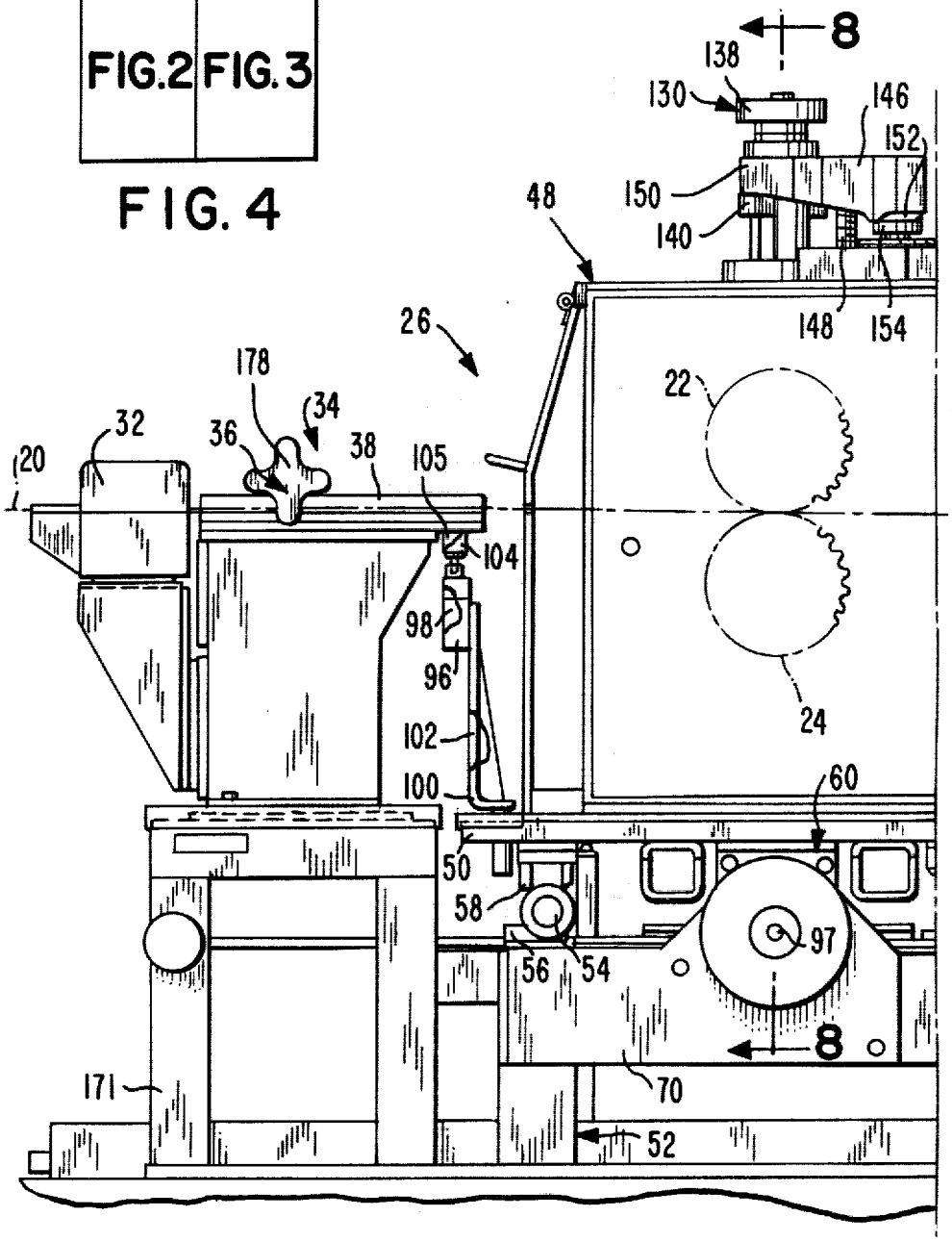
FIG. 2 is a side elevation view of a first portion of a corrugating apparatus in accordance with certain principles of the invention.
Figure 3:
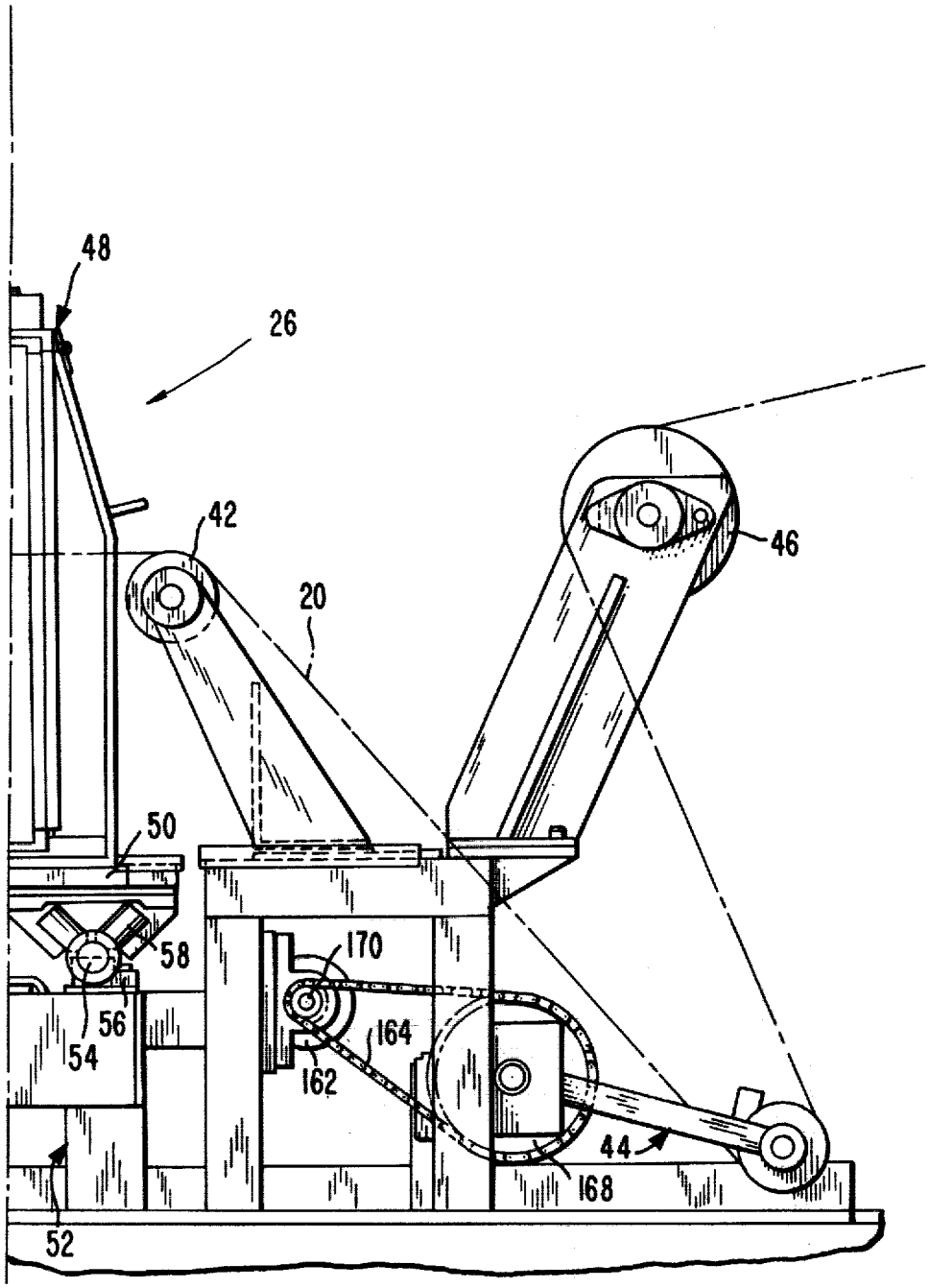
FIG. 3 is a side elevation view of the remaining portion of the corrugating apparatus of FIG. 2.

Referring to FIGS. 1, 2 and 3, lateral corrugations 18 (FIG. 1) of uniform depth are formed in a strip of metal tape 20 as the tape is passed between a pair of opposed upper and lower corrugating rollers 22 and 24, respectively, of a corrugating apparatus designated generally by numeral 26. For this purpose, as shown in FIG. 1, the peripheries of the rollers 22 and 24 are formed with alternating grooves 28 and corrugating ribs 30 extending the length thereof and which mutually cooperate to form the lateral corrugations 18 in the tape 20. Further, the upper and lower rollers 22 and 24 are mounted in the corrugating apparatus 26 (FIG. 2) for continuous reciprocation laterally of the tape 20 as the tape is being advanced between the rollers. The lateral reciprocation of the rollers 22 and 24 results in the distribution of wear on the corrugating ribs 30 of the rollers uniformly over substantially the entire length of the rollers. As a result, the corrugating apparatus 26 is capable of forming corrugations 18 to a uniform depth in other metal tapes (not shown) of varying widths without changing the upper and lower rollers 22 and 24 in the corrugating apparatus 26.

In the past, when using back-up rollers (not shown) to prevent undesirable deflection of the corrugating rollers, corrugating rollers of a relatively small diameter and of a given length were used to form corrugations having selected parameters and configurations. Due to difficulty in set-up and maintenance of the back-up rollers, as well as the undesirable noise generated thereby during a corrugation operation, it was decided to eliminate the back-up rollers. In considering the elimination of the back-up rollers, corrugating rollers of the same length but of relatively larger diameters were tried. In order to retain the selected parameters and configuration of corrugations, the larger-diameter rollers contained more corrugation-forming ribs than the smaller-diameter rollers. However, the individual ribs of both the larger and smaller rollers were of substantially the same dimensional parameters and configuration. Further, since the larger rollers had a flatter peripheral curvature than the smaller rollers, more contact was made with the tape at any one time by the larger rollers than with the smaller rollers. This caused undesirable stretching of the metal tape and resultant thinning thereof beyond acceptable limits when rollers of too large a diameter were used. Accordingly, in order to satisfy design intent, as well as maintain economical use of material, the corrugating rollers 22 and 24 preferably are of an intermediate diameter such that they neither readily deflect during a corrugating operation, nor cause stretching and thinning of the tape 20 during the corrugating operation.

Figure 5:
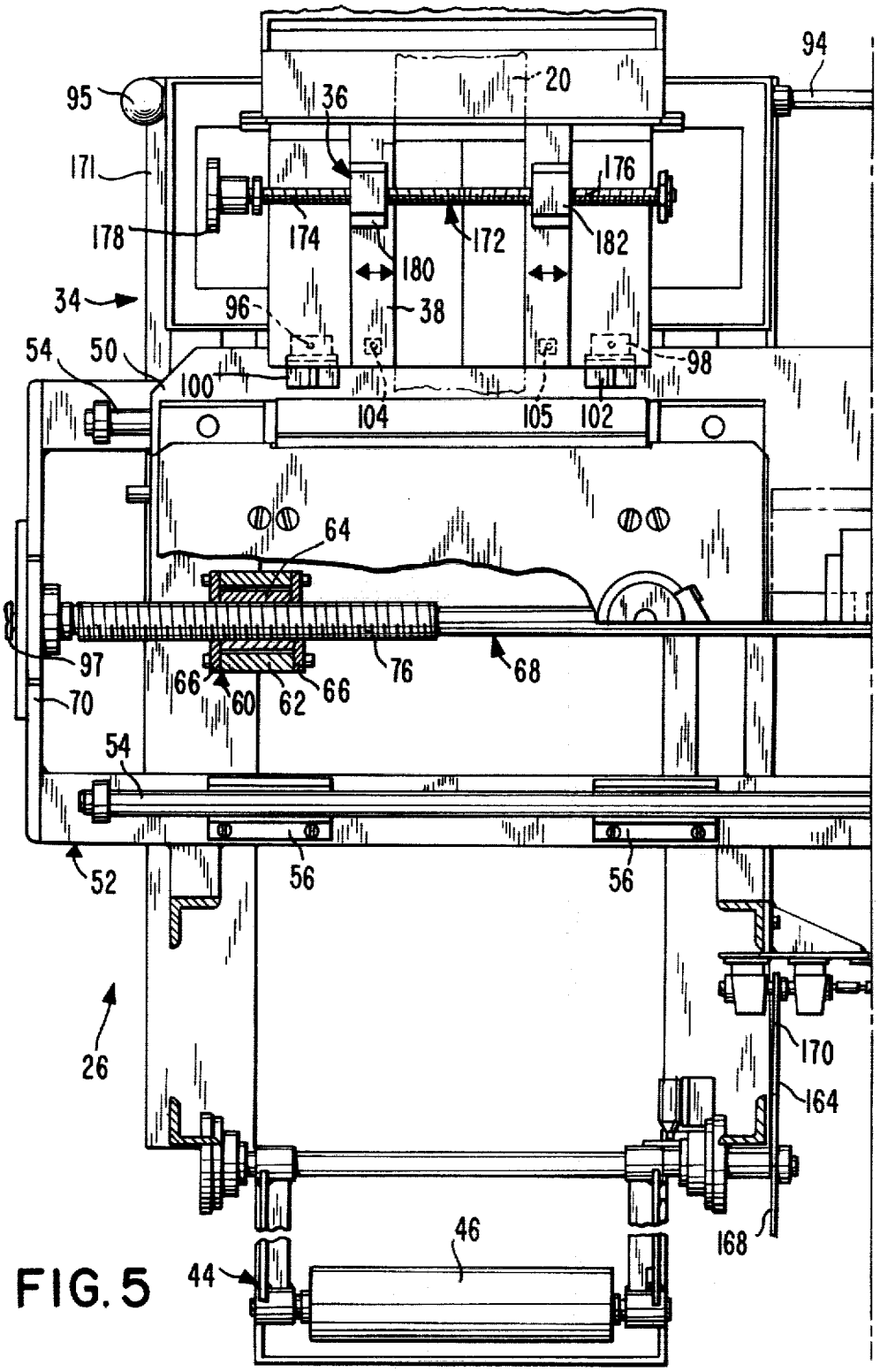
FIG. 5 is a plan view of the first portion of the corrugating apparatus of FIG. 2 with portions being broken away for clarity.

During the corrugating operation, the tape 20 is first passed from a supply reel (not shown) through a coating reservoir 32 of a tape guide assembly, designated generally by numeral 34, wherein a lubricant is deposited onto the tape in a known manner. Referring to FIGS. 2 and 5, the tape guide assembly 34 is adjustable by the facility of a screw-operated adjusting mechanism, designated generally by the numeral 36 (FIG. 5), to move a pair of opposed guide plates 38 and 40 (FIG. 5) of the tape guide assembly inwardly or outwardly relative to one another to accommodate therebetween tapes of different widths. From the tape guide assembly 34, and referring to FIG. 3, the tape 20 passes between the corrugating rollers 22 and 24 of the corrugating apparatus 26, as previously described, over a first guide roller 42, around a dancer arm assembly, designated generally by the numeral 44, for controlling the speed of the corrugating rollers, and over a second guide roller 46. The metal tape 20 is then advanced to a conformer apparatus (not shown) wherein the corrugated tape is formed longitudinally around a cable in a process similar to that described in U.S. Pat. No. 4,100,003 which is incorporated herein by reference.

As illustrated in FIGS. 2, 3, 8 and 9, the corrugating rollers 22 and 24 are mounted in a housing, designated generally by the numeral 48, which is mounted on a reciprocable support platform or carriage 50 of the corrugating apparatus 26. As further illustrated in FIGS. 2, 3 and 5, the corrugating apparatus 26 includes a frame, designated generally by numeral 52 (FIGS. 2, 3 and 5), which supports a pair of parallel cylindrical platform guide rails 54 extending the length of the frame. A plurality of cradle members 56 for supporting the guide rails 54 are secured to the frame 52 and are appropriately spaced along the length thereof. The guide rails 54 rest in the plurality of cradle members 56 such that an upper periphery of each of the guide rails is exposed throughout its length. A plurality of roller bearings 58 are mounted at spaced locations along the underside of the reciprocating platform 50 and engage the upper periphery of the guide rails 54 of the frame 52 to permit movement of the platform relative to the guide rails.

As shown in FIGS. 5, 6, 8 and 10, to facilitate the reciprocating motion of the platform 50, a driving mechanism, designated generally by the numeral 60, is mounted on the underside of the platform. The driving mechanism 60 includes a cap member 62 bolted to the underside of the platform 50 adjacent the left end thereof as viewed in FIG. 5. A nonrotatable rectangular nut 64 having side walls which mate with inner walls of the cap member 62 is positioned within the cap member and is longitudinally retainable therein by retaining plates 66 secured to both ends of the cap member. The driving mechanism 60 further includes a drive screw, designated generally by numeral 68, supported at one end thereof by an end plate 70 of the frame 52 and at the other end thereof by a pillow block 72 (FIG. 6) secured to a cross member 74 (FIG. 6) of the frame. The drive screw 68 has a threaded portion 76 at the left end thereof as viewed in FIG. 5 which extends through and threadedly engages the rectangular nut 64. Upon rotation of the drive screw 68, the platform 50 moves along the guide rails 54 relative to the frame 52.

Figure 6:
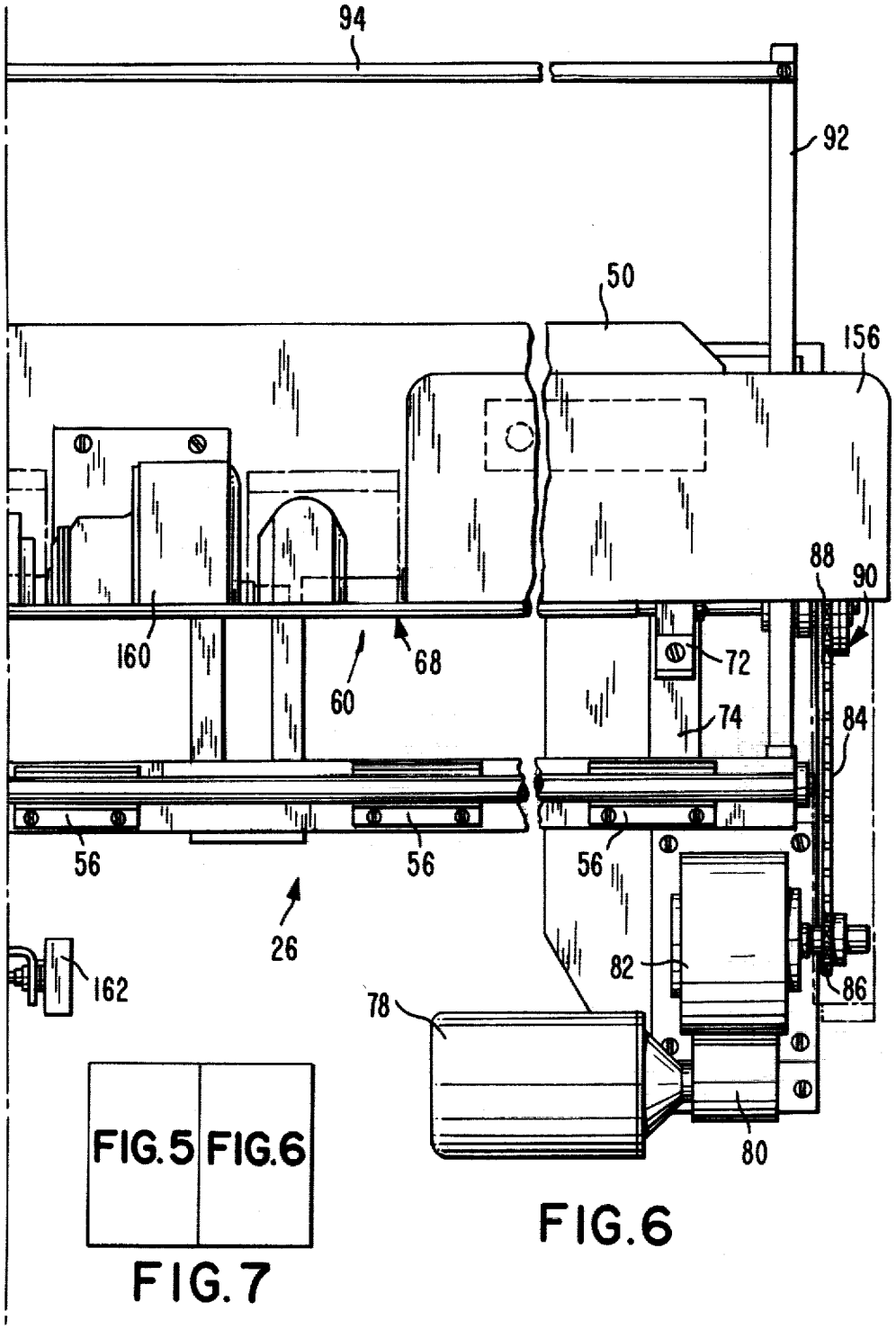
FIG. 6 is a plan view of the remaining portion of the corrugating apparatus of FIG. 3 with portions being broken away for clarity.

As illustrated in FIG. 6, a floor-mounted reversible motor 78 is provided to rotate the screw 68 of the driving mechanism 60. The motor 78 is coupled to speed reducers 80 and 82, respectively. A drive chain 84 extends between a drive sprocket 86 coupled to the speed reducer 82 and a driven sprocket 88 mounted at one end of the drive screw 68. A clutch mechanism, designated generally by numeral 90, is provided for engaging or disengaging the drive motor 78 with the drive screw 68. The clutch mechanism 90 is controllable by a manually operable lever 92 having an actuating rod 94 and handle 95 (FIG. 5) connected thereto. When the handle 95 of the actuating rod 94 is pushed to the left or the right, the clutch mechanism 90 facilitates engagement or disengagement of the drive motor 78 and the screw 68.

A manual crank 97 (FIG. 5) is provided at one end of the drive screw 68 for initially positioning the platform 50 and the corrugating rollers 22 and 24 with respect to the tape 20. To operate the crank 97, the drive screw 68 is first disengaged from the motor 78, through the clutch mechanism 90, by the operation of the handle 95 of the actuating rod 94. The hand crank 97 can then be rotated, thereby moving and positioning the platform 50 and the corrugating rollers 22 and 24 to a desired location with respect to the tape 20.

As viewed in FIGS. 2 and 5, a pair of limit switches 96 and 98 are mounted on brackets 100 and 102, respectively, which are secured to the reciprocating platform 50. The limit switches 96 and 98 are alternately operated by a pair of switch camming members 104 and 105, respectively, mounted on the guide plates 38 and 40, respectively, of the tape guide assembly 34 to alternately reverse the motor 78 for the drive screw 68 thereby causing the platform 50 to reciprocate.

Figure 8:
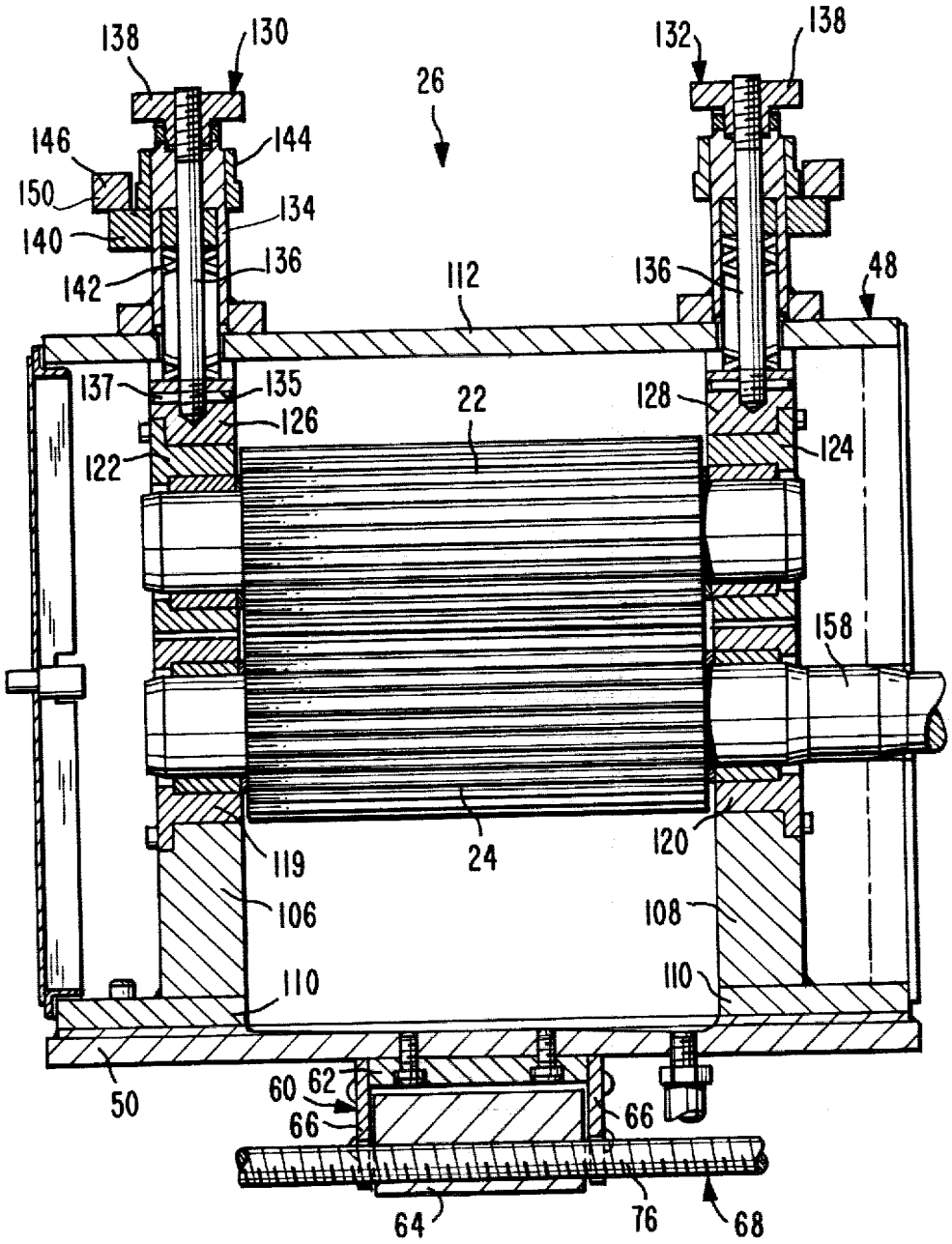
FIG. 8 is an enlarged sectional view of a portion of the corrugating apparatus taken along line 8—8 of FIG. 2.
Figure 9:
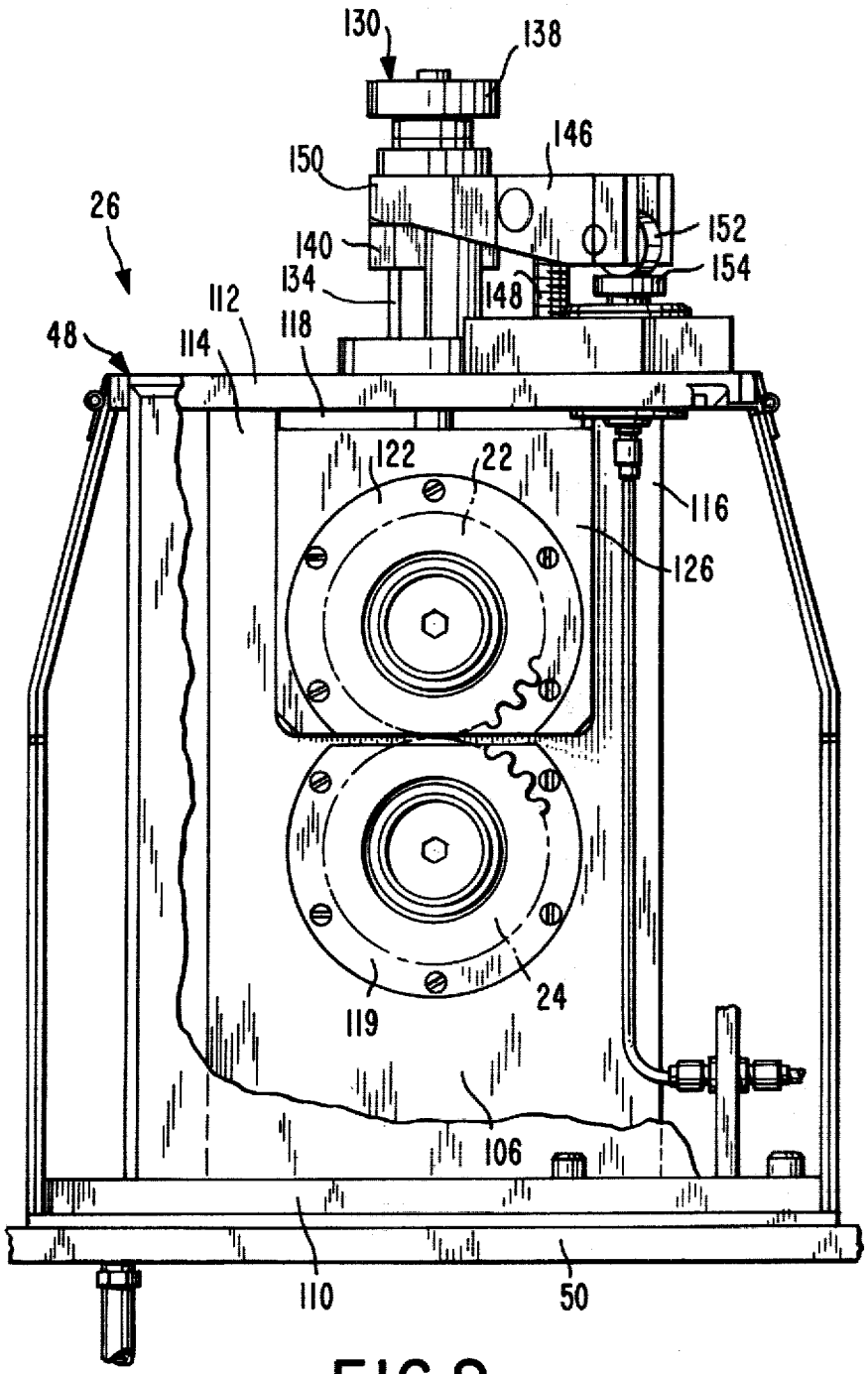
FIG. 9 is a side elevation view of the portion of the corrugating apparatus shown in FIG. 8.

As viewed in FIGS. 8 and 9, the housing 48 which supports the corrugating rollers 22 and 24, includes a pair of side walls 106 and 108 extending vertically from a mounting plate 110 secured to the platform 50. A top plate 112 is secured to the upper ends of the side walls 106 and 108. As illustrated in FIG. 9 with respect to side wall 106, each of the side walls 106 and 108 are formed with a pair of upwardly extending arm portions 114 and 116 which are parallel and provide for the formation of a space 118 therebetween. With this arrangement, each of the side walls 106 and 108 are generally of "U" shaped configuration. The lower roller 24 extends horizontally between lower portions of the side walls 106 and 108 and is fixedly mounted at opposite ends in bearing supports 119 and 120 secured to the respective side walls. The upper roller 22 is supported at opposite ends by bearing supports 122 and 124 which are mounted to a pair of spaced sliding plates 126 and 128, respectively. The sliding plates 126 and 128 are vertically positionable within the spaces 118 between the arm portions 114 and 116 of the side walls 106 and 108. The sliding plate 126 and 128 are each formed with a suitable guide member (not shown) which cooperates with the arm portions 114 and 116 of the side walls 106 and 108 to permit only vertical movement of the plates relative to the side walls.

Referring to FIGS. 8 and 9, a pair of adjusting mechanisms, designated generally by the numerals 130 and 132, are mounted on the top plate 112 for vertically positioning the upper roller 22 with respect to the lower fixed roller 24, thereby establishing the depth of corrugation to be formed in the tape 20. The adjusting mechanisms 130 and 132 are identical in structure. Therefore, only mechanism 130 will be described in detail. However, it is to be understood that mechanism 132 includes identical elements and functions in the same manner as mechanism 130.

The adjusting mechanism 130 includes a cylindrical member 134 secured to the top plate 112 of the housing 48. A connecting rod 136 having threaded portions at opposite ends thereof extends longitudinally through the cylindrical member 134 and is threadedly fastened at the lower end to the sliding plate 126. The connecting rod 136 of the adjusting mechanism 132 is connected in similar fashion to the sliding plate 128. An aperture 135 is drilled transversely through the sliding plates 126 and 128 and the connecting rods 136 wherein a locking pin 137 is positioned therethrough to lock each of the connecting rods in threaded engagement with the respective sliding plate. The upper end of the connecting rod 136 threadedly engages an adjusting nut 138 mounted for rotational movement on the cylindrical member 134. Vertical movement of the upper roller 22 is accomplished by simultaneously rotating the adjusting nuts 138 of the mechanisms 130 and 132 which causes vertical, axial movement of the rods 136 whereby the sliding plates 126 and 128, respectively, move upwardly or downwardly.

A spring block 140 having lateral portions which extend into the cylindrical member 134 is mounted for upward and downward movement relative to the cylindrical member. A plurality of dishshaped springs 142 are stacked in series within the cylindrical member 134 and are captured between the spring block 140 and the sliding plates 126 and 128. A locking collar 144, which is threadedly mounted on the cylindrical member 134, has lower portions which are also engageable with the spring block 140. As shown in FIG. 9, a lever 146 is pivotally mounted intermediate its ends on a support member 148 secured to the top plate 112 of the housing 48. A free end 150 of the lever 146 normally rests against portions of the spring block 140 while the other end of the lever supports a cam roller 152 which bears against a hydraulically-controlled plunger 154.

To facilitate the application of sufficient downward corrugating pressure through the upper roller 22 while permitting limited upward resiliency of the roller, the springs 142 of the mechanisms 130 and 132 are compressed so as to apply a downward force on the sliding plates 126 and 128, respectively. In one method of compressing the springs 142, the hydraulic plunger 154 is raised to move upwardly against cam roller 152 of the lever 146 thereby causing the lever to pivot. As the lever 146 pivots, the free end 150 thereof pushes downwardly against the spring block 140 thereby compressing the springs 142. The locking collar 144 is then threadedly moved downwardly to the position on the cylindrical member 134 which coincides with the assumed position of the spring block 140. When the hydraulically controlled plunger 154 is lowered, the locking collar 144 retains the springs 142 in compression. In the alternative, the locking collar 144 can be used independently of the lever 146 by simply threadedly moving the collar to the desired position on the cylindrical member 134, thereby compressing or relieving the compression of the springs 142.

To advance the tape 20 through the corrugating apparatus 26, the lower roller 24 is driven by a drive motor 156 (FIG. 6) mounted on the platform 50. A drive shaft 158 (FIG. 8) secured at one end to the lower roller 24, is coupled through a speed reducer 160 (FIG. 6) to the motor 156. The speed of the motor 156, which determines the rate of corrugation of the tape 20, is controlled by a rheostat 162 (FIGS. 3 and 6) which functions in a known manner to regulate the current flow to the motor. A connecting chain 164 (FIGS. 3 and 5) for controlling the adjustment of the rheostat 162 extends between a first sprocket 168 on the dancer arm assembly 44 and a second sprocket 170 mounted on the rheostat. As the dancer arm assembly 44 pivotally moves upwardly or downwardly as a result of the tape 20 passing therearound, the rheostat 162 is adjusted through the chain 164, thereby controlling the speed of the rollers 22 and 24 and maintaining a desired rate of corrugation.

As illustrated in FIG. 5, the screw-operated adjusting mechanism 36 is mounted on a stationary support stand 171 and includes a threaded shaft, designated generally by the numeral 172, having reverse threads 174 and 176 from the center to opposite ends thereof. The shaft 172 is supported for rotation at opposite ends thereof and is coupled to a manual knob 178 at the left end thereof. A pair of blocks 180 and 182 having axially aligned threaded apertures, mounted on the plates 38 and 40, respectively, are positioned to receive threadedly through the apertures the threads 174 and 176, respectively, of the shaft 172. Therefore, as the knob 178 is rotated, the shaft 172 rotates and thereby threadedly drives the blocks 180 and 182 toward or away from each other dependent upon the direction of rotation of the knob. This facilitates positioning of the guide plates 38 and 40 as desired to accommodate the tapes 20 of different widths.

When the guide plates 38 and 40 are adjusted by operation of the adjusting mechanism 36, the camming members 104 and 105 are positioned accordingly to establish the limits of reciprocating travel of the platform 50 and the rollers 22 and 24.

In the operation of the corrugating apparatus 26, the tape 20 is first positioned between the guide plates 38 and 40 of the tape guide assembly 34. The width of the tape 20 establishes the location of the camming members 104 and 105 secured to the guide plates 38 and 40, respectively. The position of the camming members 104 and 105 determine the distance of traversing travel of the corrugating rollers 22 and 24 during the corrugating operation. The tape 20 is then threaded between the corrugating rollers 22 and 24, over the first guide roller 42, around the dancer arm assembly 44 and over the second guide roller 46. From the second guide roller 46 the tape 20 is advanced to the conformer (not shown) wherein the tape is formed about a cable (not shown).

The corrugating rollers 22 and 24 are positioned laterally with respect to the axis of the tape 20 by the operation of the manual crank 97 for rotating the drive screw 68. After properly locating the rollers 22 and 24 in the desired lateral position relative to the tape 20, the depth of corrugation is determined by the operation of the adjusting mechanisms 130 and 132. The drive motor 156 for the lower roller 24 is then engaged and the tape 20 is advanced between the rollers 22 and 24.

Actuation of the drive motor 78 for the screw 68 causes the platform 50, and consequently the corrugating rollers 22 and 24, to move together in one lateral direction relative to the advancing tape 20 at a speed of approximately two inches per hour. For example, the platform 50 is moved to the left as viewed in FIG. 5 whereby the camming member 104 moves towards the limit switch 96. Movement in this direction of the platform 50 continues until the camming member 104 engages the limit switch 96 whereupon the drive motor 78 is reversed and the platform 50 thereby moves the corrugating rollers 22 and 24 together to the right as viewed in FIG. 5. Subsequently, the camming member 105 engages the limit switch 98 whereby the drive motor 78 is again reversed and the platform 50 moves to the left as viewed in FIg. 5.

The reciprocating movement of the platform 50 and consequently the rollers 22 and 24 is continuous during the corrugating operation. In this manner, substantially the entire surface of the rollers 22 and 24 is utilized during the corrugating operation thereby distributing wear evenly over the surface of the rollers. The continuous reciprocation of the platform 50, and the rollers 22 and 24, thus provides for the avoidance of the deleterious effects of localized wear of the rollers. Further, the location of the camming members 104 and 105 on the guide assembly 34 facilitates the establishment of the distance of reciprocating travel of the rollers 22 and 24 for each width of tape 20 to be passed between the rollers. In addition, the elimination of back-up rollers substantially reduces set up and maintenance time, and effectively reduces noise pollution.

What is claimed is:

1. An apparatus for forming corrugations in a tape, which comprises:

a pair of opposed corrugating rollers for forming the corrugations in the tape;

means for rotating said corrugating rollers;

means for advancing the tape between said corrugating rollers;

a carriage reciprocable transversely of and relative to the path of travel of the tape between said corrugating rollers, said corrugating rollers being mounted on said carriage for reciprocable movement therewith; and means for reciprocating continuously said carriage to reciprocate continuously said corrugating rollers transversely of and relative to the tape together in a first direction and alternately together in a second direction reverse of the first direction as the tape advances between said corrugating rollers.

2. The apparatus as set forth in claim 1, in which said drive screw rotating means includes means for manually rotating said drive screw and positioning transversely said carriage and the pair of opposed corrugating rollers to a desired location with respect to the tape.

3. The apparatus as set forth in claim 1, wherein said reciprocating means comprises:

means for moving said carriage in the first direction and in the second direction;

means responsive to the movement of said carriage for a given distance in the first direction for controlling the moving means to move the carriage in the second direction; and means responsive to the movement of said carriage for a given distance in the second direction for controlling the moving means to move the carriage in the first direction.

4. The apparatus as set forth in claim 3, wherein said moving means comprises:

a drive screw mounted for rotating relative to said carriage;

a non-rotatable threaded nut member secured to said carriage, said drive screw threadedly engaging said nut member; and means for rotating said drive screw to move said nut member axially of said drive screw and thereby moving said carriage.

5. An apparatus for forming corrugations in tapes, which comprises:

a pair of opposed corrugating rollers for forming corrugations in a tape;

means for rotating said corrugating rollers;

means for advancing the tape between said corrugating rollers;

support means reciprocable transversely of and relative to the path of travel of the tape between said corrugating rollers, said corrugating rollers being mounted on said support means;

means for reciprocating continuously said support means to reciprocate continuously said corrugating rollers transversely of and relative to the tape together in a first direction and alternately together in a second direction reverse of the first direction as the tape advances between said corrugating rollers;

means for guiding longitudinally the tape between said corrugating rollers, said guide means including a pair of opposed guide members movable toward and away from one another;

means for adjusting the spacing between said guide members of said guide means to facilitate the guiding of tapes having different widths; and control means for controlling said reciprocating means to move said support means in the first direction and alternately in the second direction, said control means being mounted in part on said support means for movement therewith, and being mounted in part on said guide members and movable therewith when the spacing between the guide members is adjusted by said adjusting means.

6. An apparatus for forming corrugations in tapes, which comprises:

a pair of opposed corrugating rollers for forming corrugations in a tape;

means for rotating said opposed corrugating rollers;

means for advancing the tape between said opposed corrugating rollers;

means for mounting said opposed corrugating rollers for reciprocable movement;

means for reciprocating continuously said mounting means in a first direction and in a second direction reverse of said first direction, to reciprocate continuously said opposed corrugating rollers transversely of and relative to the tape as the tape advances between said corrugating rollers;

means for controlling said reciprocating means to move said mounting means in the first direction and alternately in the second direction;

means for guiding longitudinally the tape between said opposed corrugating rollers, said guiding means including a support stand and a pair of plates mounted on said support stand for movement toward and away from one another;

means mounted on the support stand for adjusting the position of said plates relative to each other to adjust the space therebetween and thus facilitate the guiding of tapes having different widths; and means, mounted on said pair of plates and movable therewith when the position of said plates is adjusted, for engaging and operating said controlling means for said reciprocating means to facilitate alternate movement of said mounting means in the first and second directions.

7. The apparatus as set forth in claim 6, wherein said engaging and operating means comprises:

a first camming member mounted on a first of said pair of plates; and a second camming member mounted on a second of said pair of plates.

8. The apparatus as set forth in claim 7, wherein said controlling means comprises:

a first limit switch mounted on said mounting means for movement therewith and positioned to be engaged and operated by said first camming member, said first limit switch when operated by said first camming member facilitating control of said moving means to move said mounting means in the first direction; and a second limit switch mounted on said mounting means for movement therewith and positioned to be engaged and operated by said second camming member, said second limit switch when being operated by said second camming member facilitating control of said moving means to move said mounting means in the second direction.

9. An apparatus for forming corrugations in tapes, which comprises:

a frame;

a platform supported for movement on the frame;

a pair of opposed corrugating rollers mounted on said platform to form corrugations in a tape;

means for advancing the tape between said corrugating rollers;

means for rotating said corrugating rollers;

a support stand;

a pair of plates mounted on said support stand and spaced apart to receive the width of the tape being guided into position between said corrugating rollers;

means for supporting said pair of plates for movement on said support stand towards and away from each other;

means mounted on said support stand and in engagement with said pair of plates for adjusting the position of said plates relative to each other to adjust the space therebetween;

a drive screw having a threaded portion mounted for rotation relative to the frame;

a nonrotatable nut secured to said platform, said drive screw threadedly engaging said nut;

means for rotating said drive screw in opposite directions to move said nut axially of said drive screw in a first direction and in a second direction reverse of the first direction and thereby moving said platform accordingly;

a first camming member mounted on a first of said pair of plates;

a second camming member mounted on a second of said pair of plates;

a first limit switch mounted on said platform for movement therewith and positioned to be engaged by said first camming member, said first limit switch when operated by said first camming member facilitating control of said moving means to move said platform in the first direction; and a second limit switch mounted on said platform for movement therewith and positioned to be engaged and operated by said second camming member to facilitate control of said moving means to move said platform in the second direction.

* * * * *